US011072084B2

(12) United States Patent
Willis

(10) Patent No.: US 11,072,084 B2
(45) Date of Patent: Jul. 27, 2021

(54) VACUUM DIVERTER ASSEMBLY

(71) Applicant: Janesville Acoustics, a Unit of Jason Incorporated, Southfield, MI (US)

(72) Inventor: Michael Willis, Plainwell, MI (US)

( * ) Notice: Subject to any disclaimer, the term of this patent is extended or adjusted under 35 U.S.C. 154(b) by 53 days.

(21) Appl. No.: 16/242,496

(22) Filed: Jan. 8, 2019

(65) Prior Publication Data

US 2019/0210240 A1 Jul. 11, 2019

Related U.S. Application Data

(60) Provisional application No. 62/614,922, filed on Jan. 8, 2018.

(51) Int. Cl.
*B26F 3/00* (2006.01)
*B24C 1/04* (2006.01)

(52) U.S. Cl.
CPC ..... *B26F 3/004* (2013.01); *B24C 1/045* (2013.01); *B26F 2003/006* (2013.01)

(58) Field of Classification Search
CPC ..... B26F 3/004; B26F 2003/006; B24C 1/045
See application file for complete search history.

(56) References Cited

U.S. PATENT DOCUMENTS 3,580,416 A * 5/1971 Hoenisch ..... F25C 5/20 221/203
3,995,356 A 12/1976 Sheppard
4,060,984 A 12/1977 Paddock
4,191,104 A 3/1980 Jones
4,204,448 A 5/1980 Pearl
4,467,941 A 8/1984 Du
4,913,315 A * 4/1990 Wagner ..... B01F 11/0258 221/200
4,961,446 A * 10/1990 Berg ..... B65B 25/061 141/137
4,964,575 A * 10/1990 Takata ..... A01C 15/04 239/655
5,014,924 A * 5/1991 Nowisch ..... B26F 3/004 242/526.3
5,029,737 A * 7/1991 Yamamoto ..... F25C 5/24 222/526
5,226,400 A 7/1993 Birch
(Continued)

FOREIGN PATENT DOCUMENTS

JP 2005-231000 A 9/2005

OTHER PUBLICATIONS

International Search Report and Written Opinion from PCT/US2019/012668—dated May 27, 2019.

*Primary Examiner* — Omar Flores Sanchez
(74) *Attorney, Agent, or Firm* — Fletcher Yoder, P.C.

(57) ABSTRACT

A vacuum diverter defined by a housing or hollow body having a first end, a second end, a plurality of sides, and an opening formed in one of the plurality of sides. A valve flap is disposed within the hollow body and moveable between a first position and a second position. The valve flap is supported by a shaft that extends across a cavity defined by the housing and which is rotationally supported by the housing such that the shaft and valve flap can be removed from the housing in a crossing direction relative to an axis of rotation of the shaft. Rotation of the shaft effectuates rotation of the valve flap relative to the cavity to selectively fluidly connect the discrete vacuum flow passages defined by the housing.

12 Claims, 8 Drawing Sheets

(56) References Cited

U.S. PATENT DOCUMENTS

| | | | | |
|---|---|---|---|---|
| 5,665,198 | A | 9/1997 | Bieber et al. | |
| 5,782,673 | A * | 7/1998 | Warehime | B24C 1/045 451/2 |
| 5,938,408 | A | 8/1999 | Krichbaum | |
| 6,176,275 | B1 | 1/2001 | Hill | |
| 6,827,529 | B1 | 12/2004 | Berge et al. | |
| 7,455,568 | B2 * | 11/2008 | Sekiya | B24C 1/045 451/11 |
| 8,020,724 | B2 | 9/2011 | Remis et al. | |
| 8,322,951 | B2 * | 12/2012 | Kvalheim | B65G 65/36 406/109 |
| 8,348,094 | B2 | 1/2013 | Remis et al. | |
| 8,844,310 | B2 * | 9/2014 | Chase | F25C 5/22 62/344 |
| 9,194,102 | B2 | 11/2015 | Buckner | |
| 9,212,839 | B2 * | 12/2015 | McCoy | A47G 19/32 |
| 9,527,610 | B1 * | 12/2016 | Bareford | B65B 61/28 |
| 2002/0153332 | A1 | 10/2002 | Fout et al. | |
| 2002/0157713 | A1 | 10/2002 | Pimouguet | |
| 2003/0092361 | A1 | 5/2003 | Erickson et al. | |
| 2004/0194822 | A1 | 10/2004 | Breda | |
| 2005/0051211 | A1 | 3/2005 | Scott | |
| 2005/0092361 | A1 | 5/2005 | Hoffman | |
| 2007/0256271 | A1 | 11/2007 | Rhea | |
| 2008/0257703 | A1 | 10/2008 | Jonsson et al. | |
| 2011/0005361 | A1 | 1/2011 | Hamann et al. | |
| 2011/0031220 | A1 | 2/2011 | Nilsson et al. | |
| 2014/0047666 | A1 | 2/2014 | Morgan et al. | |
| 2016/0010659 | A1 | 1/2016 | Dharmasena et al. | |

* cited by examiner

VACUUM DIVERTER ASSEMBLY

CROSS-REFERENCE TO RELATED PATENTS

This application claims priority to U.S. Provisional Patent Application Ser. No. 62/614,922 filed on Jan. 8, 2018, titled "Vacuum Diverter Assembly" and the disclosure of which is expressly incorporated herein.

FIELD OF THE INVENTION

The invention relates generally to a vacuum diverter for use with water jet devices such as water jet cutting tables and, more particularly, to a vacuum diverter assembly having a valve flap that transitions between first and second positions to control the direction of a vacuum flow.

BACKGROUND OF THE INVENTION

Water jet cutting tables are used across a plurality of industries for their ability to efficiently cut or process a wide variety of materials including stone, metal, cloth, paper, fiber, etc., materials. Such cutting tables commonly include a cutting nozzle, a vacuum table assembly, and a drive and control system configured to effectuate a desired relative translation between the cutting nozzle and the material associated with the table. A vacuum pressure signal is commonly employed to maintain a desired relative orientation or position of the material being worked relative to the bed of the table of the water jet cutting system. As the cutting nozzle translates relative to the material secured to the cutting table by the vacuum signal, a cutting stream is discharged from the cutting nozzle and impinged upon the material being worked to effectuate the cutting operation during the desired translation between the cutting nozzle and the material associated with the cutting table. Although such cutting table assemblies are capable of efficiently working a wide variety of materials, such assemblies present several difficulties associated with maintaining the desired operational condition associated with the water jet cutting table system.

In one aspect, during the cutting operation, any aggregate associated with the cutting fluid flow and the spoils associated with the cutting operation of the working material are carried from the material working areas by rinse solutions and/or the jet fluid flow stream associated with the cutting nozzle to other areas of the water jet cutting table assembly so as to not interfere with continued processing of the working materials. Any aggregate carried on the cutting stream and the spoils associated with cutting operations can undesirably collect in areas of the cutting table assembly and hinder desired operation of the cutting table and operation of the associated vacuum signal flows. Accordingly, a first aspect of the present application is directed to providing a vacuum signal control arrangement that can better withstand and accommodate collection of cut debris and/or aggregate without detracting from desired operability of the vacuum signal control agreement.

Another aspect of the present application is directed to maintaining a desired operational condition associated with the vacuum signal system and vacuum table assembly. Selectively securing and removing blank or bulk materials that have yet to be worked, worked materials, and/or cutouts or scrap materials during or after a cutting operation requires the periodic suspension of communication of the vacuum pressure signal from the cutting table. That is, when the vacuum pressure signal is communicated to the cutting table, it is commonly impossible or impractical to remove the working materials or cutouts generated during the cutting operation from the cutting table.

Whereas some approaches fully suspend operation of the vacuum pressure signal system to effectuate each desired translation of working or worked materials relative to the cutting table, other approaches manipulate the vacuum pressure signal flow paths to allow users to interact with and manipulate the materials associated with the vacuum cutting table. Unfortunately, both approaches suffer from discrete drawbacks. Those approaches that suspend operation of the systems associated with the generation of the vacuum pressure signal inefficiently utilize such vacuum cutting tables due to the dwell times associated with repeatedly generating and suspending the vacuum pressure signal communicated to the table to provide the desired selective securing and releasing of the materials associated with the vacuum pressure cutting table. With each "secure" and "release" cycle associated with the desired generation of the vacuum pressure signal, the various vacuum flow passages and the vacuum table cavities and passages must be evacuated to generate the desired vacuum pressure signal to effectuate the sequential securing and releasing of the working materials relative to the bed of the vacuum cutting table.

Those approaches that rely on only selectively communicating the vacuum pressure generating flow signal to the cutting table suffer from other drawbacks that can also detrimentally affect efficient utilization and long term operating performance of the vacuum cutting table. Such systems commonly include one or more diverter or bypass flow passages, valves, and/or assembles that are configured to maintain operation of the vacuum signal generation unit but reduce or redirect a portion or the entirety of the vacuum pressure signal communicated to the bed of the cutting table such that the working materials associated with the cutting table can be placed, translated, or removed from the cutting table. Unfortunately, any aggregate associated with the cutting fluid flow and the waste materials created during the material cutting operations can dramatically affect operability of such vacuum flow control arrangements. That is, aggregate and cutting debris have a tendency to collect during use of the vacuum cutting table in a manner that inhibits the intended operation of the vacuum flow control structures. Obstruction or inoperability of the vacuum flow control structures can render the waterjet cutting table system inoperable or unusable until the desired operability of the vacuum flow control operability is reestablished. Unfortunately, reestablishing operability of the vacuum flow control system is frequently encumbered by the placement and construction of the vacuum flow control arrangement relative to other structures associated with the waterjet vacuum table cutting system.

The structures associated with the selectively operable vacuum flow control systems are commonly provided in constructions and locations that inhibit any ability to service the vacuum flow control arrangement. Commonly, obstructed, plugged or otherwise damaged selectively operable vacuum flow control arrangements are wholly replaced rather than being serviced as servicing of the same is rendered impractical if not impossible. Still further, replacement even service of such vacuum flow control arrangements can also require at least a partial disassembly or removal of other structures associated with the waterjet vacuum cutting table assembly simply to gain access to the vacuum flow control arrangement. As such, failures or demands for service associated with known selectively operable vacuum flow control arrangements commonly results in extended or protracted periods associated with maintaining operability of such systems.

Therefore, there is a need for a water jet cutting table vacuum flow control assembly that provides selective communication of the vacuum pressure signal to the cutting table and can withstand the rigors associated with a harsh operating environment. There is a further need for a cutting table vacuum flow control assembly having a robust construction but is more readily capable of inspection, accessible, and serviceable to maintain the desired operating condition of the vacuum flow control arrangement and a waterjet cutting table associated therewith.

SUMMARY OF THE INVENTION

The present invention is directed to a vacuum diverter for use with a water jet device and discloses a vacuum flow diverter assembly and waterjet cutting table system and assembly that resolves or overcomes one or more of the drawbacks disclosed above.

According to one aspect of the application, a vacuum diverter includes a housing or hollow body that is generally defined by a first end, a second end, a plurality of sides, and an opening or window formed in one of the plurality of sides. A flap valve is disposed within the hollow body and operable or moveable between a first position and a second position. A plurality of bearings are disposed on generally opposite sides of the hollow body and support a shaft that is rotatably or rotatively supported by the plurality of bearings and which extends between the respective bearings. The valve flap is secured to the shaft. When the valve flap is oriented in the first position, the second end and the opening of the housing are fluidly connected to one another via the housing. When the flap valve is oriented in the second position, the first end and second end of the housing are fluidly connected to one another.

In accordance with another aspect of the application, a linear actuator, such as a hydraulic, pneumatic, electric, or electro-mechanical cylinder, is coupled to the shaft and transitions between extended and retracted positions to transition the valve flap from the first position to the second position.

In accordance with yet another aspect of the application, the window includes a window frame that is removably coupled to one of the plurality of sidewalls of the hollow body. A gasket is disposed between the hollow body and the window frame. Further, a mesh grill is preferably disposed within an opening of the window and/or window frame.

In accordance with another aspect of the application, a service plate is removably coupled to a sidewall of the hollow body along a portion of the sidewall associated with the shaft. A gasket is preferably disposed between the hollow body and the service plate. In addition, a top end of the valve flap may engage with a gasket underneath the service plate when the valve flap is oriented in the first position relative to the housing.

According to another aspect of the application, a water jet device includes a frame, a buck plate disposed atop the frame, a tub disposed underneath the buck plate, and a vacuum diverter disposed adjacent the tub. The vacuum diverter includes a hollow body having a first end, a second end, a plurality of sides, and a window formed in one of the plurality of sides. A bearing is associated with each of a respective one of a pair of laterally spaced apart opposite sides of the hollow body and a shaft is rotatably associated with each of the respective bearings and extends therebetween. A valve flap is disposed within the hollow body and coupled to the shaft. The valve flap is operable between a first position and a second position. When the valve flap is oriented in the first position, the second end and the opening of the housing are fluidly connected to one another and when the valve flap is oriented in the second position, the first end and second end of the housing are fluidly connected to one another.

In accordance with another aspect of the application, a linear actuator, such as a pneumatic, hydraulic, electric, or electromechanical cylinder is coupled to a first end of the shaft and is operable between a retracted position and an extended position. The transition of the linear actuator between an extended position and a retracted position causes the shaft to rotate and the valve flap to transition between the first position to the second position relative to the housing. In a preferred aspect, a crank arm is disposed between the linear actuator and the shaft associated with the valve flap to provide a mechanical advantage associated with the operation therebetween.

In accordance with yet another aspect of the application, the window includes a window frame removably coupled to one of the plurality of sidewalls of the hollow body. A gasket is disposed between the hollow body and the window frame. Further, a mesh grill is disposed within an opening of the window.

In accordance with another aspect of the application, a service plate is removably coupled to a sidewall of the hollow body along a portion of the sidewall associated with the shaft. A gasket is disposed between the hollow body and the service plate. In addition, a top end of the valve plate may engage with the gasket underneath the service plate when the valve plate is oriented in the first position relative to the housing.

According to yet another aspect of the application, a method of manufacturing a vacuum diverter is disclosed that includes providing a hollow body having a first end, a second end, a plurality of sides, and a window formed in one of the plurality of sides. A shaft extends across a cavity defined by the hollow body and includes opposing ends that are rotationally supported by the hollow body. In a preferred aspect, a bearing is associated with each of the respective opposing ends of the shaft and the hollow body. A valve flap is coupled to the shaft such that the valve flap is disposed within the hollow body and moveable between a first position and a second position relative to the cavity defined by the hollow body. When the valve flap is oriented in the first position, the second end and the opening of the housing are fluidly connected and when the valve flap is oriented in the second position, the first end and second end of the housing are fluidly connected to one another.

In accordance with another aspect of the application, the method includes coupling a linear actuator, such as a pneumatic cylinder, to a first end of the shaft. The pneumatic cylinder transitions between an extended position and a retracted position, which causes rotation of the shaft, which causes the valve flap to transition between the first position to the second position as a function of the operation of the linear actuator. In a preferred aspect, a crank arm is disposed between the linear actuator and the shaft.

In accordance with yet another aspect of the application, the hollow body is provided with a window and includes removably coupling a window frame to at least one of the plurality of sides of the hollow body. In preferred aspect, a gasket can be disposed between the window frame and the hollow body. In addition, a mesh grill may be disposed within an opening of the window frame.

In accordance with another aspect of the application, the method includes removably coupling a service plate to a sidewall of the hollow body along a portion of the sidewall adjacent the shaft. An opening is formed in the sidewall generally underneath the service plate and a gasket is disposed between the service plate and the hollow body. Preferably, a top end of the valve plate engages the gasket underneath the service plate, when the valve plate is in the first position relative to the hollow body and the discrete fluid paths defined thereby.

These and various other aspects, features, and advantages of the present invention will be made apparent from the following detailed description and the drawings.

BRIEF DESCRIPTION OF THE DRAWINGS

Preferred exemplary embodiments of the invention are illustrated in the accompanying drawings in which like reference numerals represent like parts throughout.

DETAILED DESCRIPTION OF THE PREFERRED EMBODIMENTS

Figure 1:
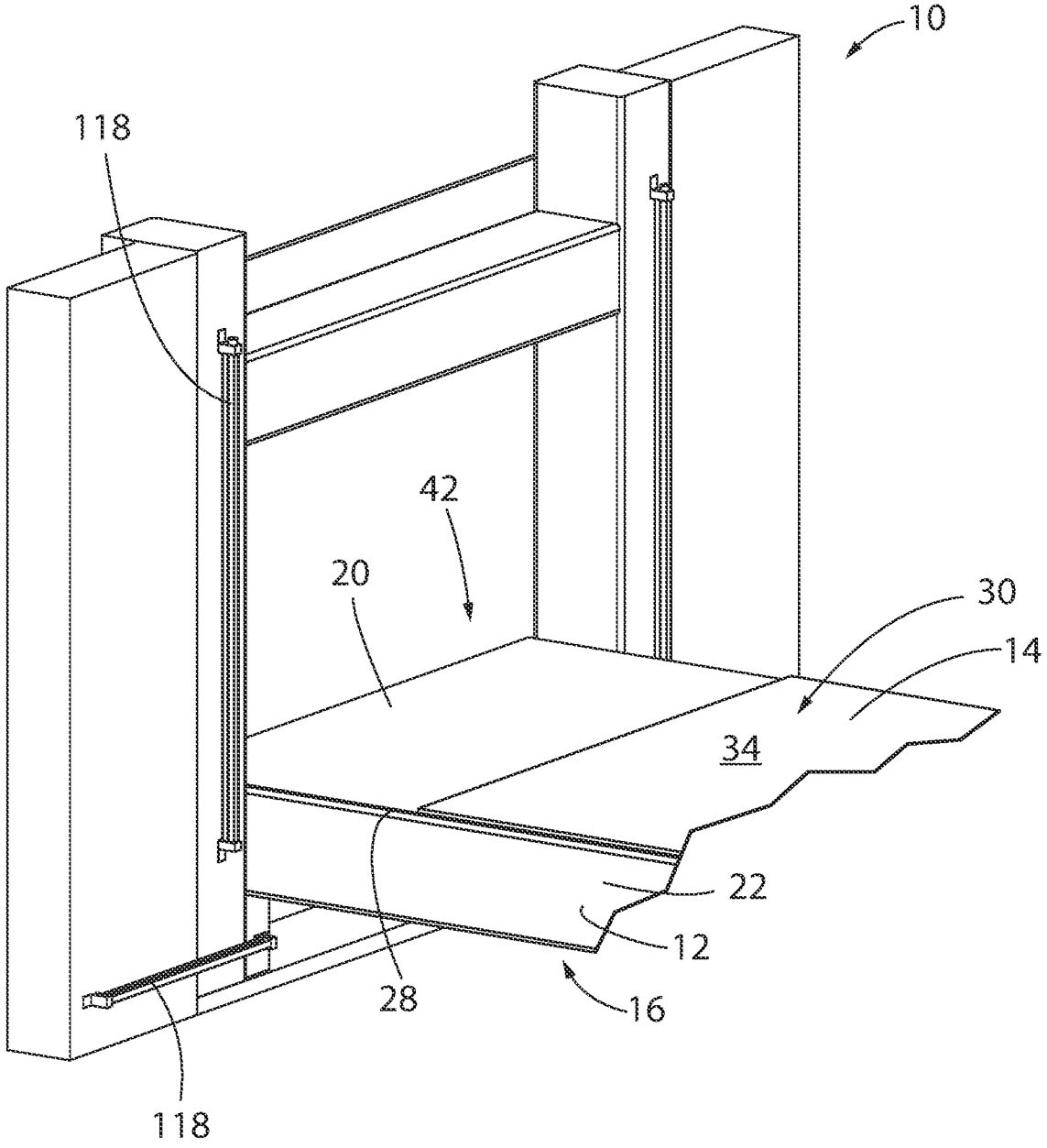
FIG. 1 is a perspective view of a water jet cutting device having a vacuum diverter assembly according to an embodiment of the invention.
Figure 2:
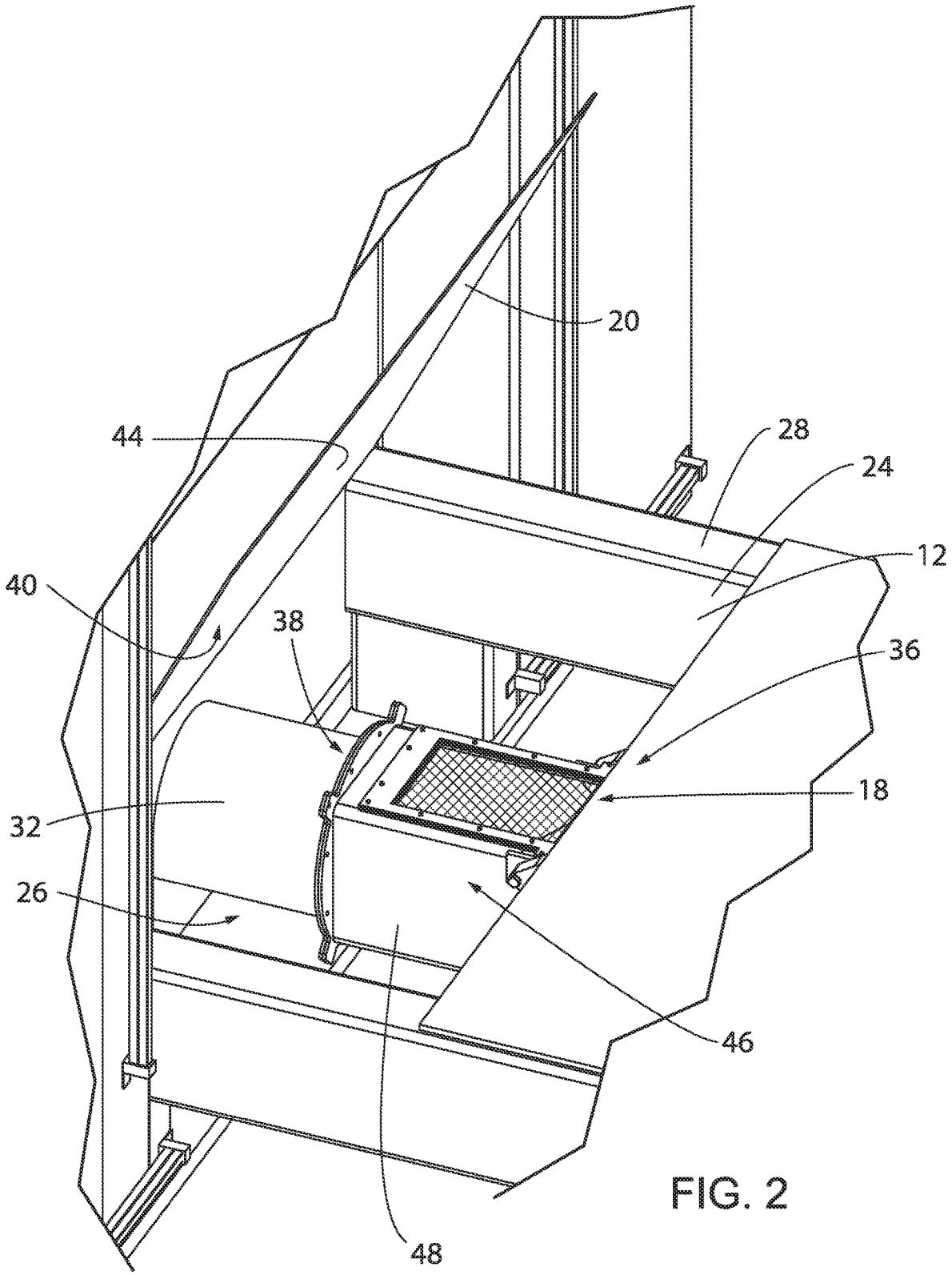
FIG. 2 is an enlarged perspective view of a portion of the water jet device of FIG. 1 associated with a vacuum diverter.

Referring now to the drawings and specifically to FIGS. 1 and 2, a perspective view of a water jet cutting system, assembly, or device 10 is shown. The water jet device 10 includes a frame 12, a vacuum table, plate, or buck plate 14, a tub 16, a vacuum diverter 18 (FIG. 2), and preferably a moveable or removeable shroud, guard, cover, or guard cover 20 (FIG. 2) associated therewith. The water jet frame 12 includes a front wall 22 and a rear wall 24 that are preferably spaced apart from each other by an opening 26. The buck plate 14 and the guard cover 20 are preferably placed on an upper surface 28 of the water jet frame 12, which supports the weight of the water jet components.

As shown in FIG. 1, the buck plate 14 and guard cover 20 are disposed adjacent each other on the upper surface 28 of the frame 12 and extend from the front wall 22 of the frame 12 to the rear wall 24 of the frame 12. The buck plate 14 is a rectangular section of material that acts as the cutting surface of the water jet device 10. The buck plate 14 may also include a plurality of orifices 30 formed therein. During operation of the water jet device 10, a nozzle (not shown) ejects a fluid, such as water, to effectuate cutting operations associated with an object or material placed on an upper surface 34 of the buck plate 14. Depending upon the material being worked, the working fluid flow may or may not include a suspended aggregate or abrasive material intended to manipulate the cutting performance associated with the flow discharged from the cutting nozzle. Regardless of the nature of composition of the cutting flow, orifices 30 formed through the buck plate 14 allow the cutting fluid associated with the cutting operation to drain through the buck plate 14 and to the tub 16 disposed underneath the buck plate 14 and within the opening 26 of the frame 12. It should be appreciated that debris associated with the cutting operation, particularly particulate cutting debris can be carried with the cutting fluid through orifices 30 during draining operations. During operation of the water jet device 10, a vacuum system (not shown) is commonly activated to retain parts relative to the cutting table or buck plate 14 and operate to draw the cutting fluid, air, and particulate debris through the orifices 30 of the buck plate 14 and into the tub 16.

Figure 3:
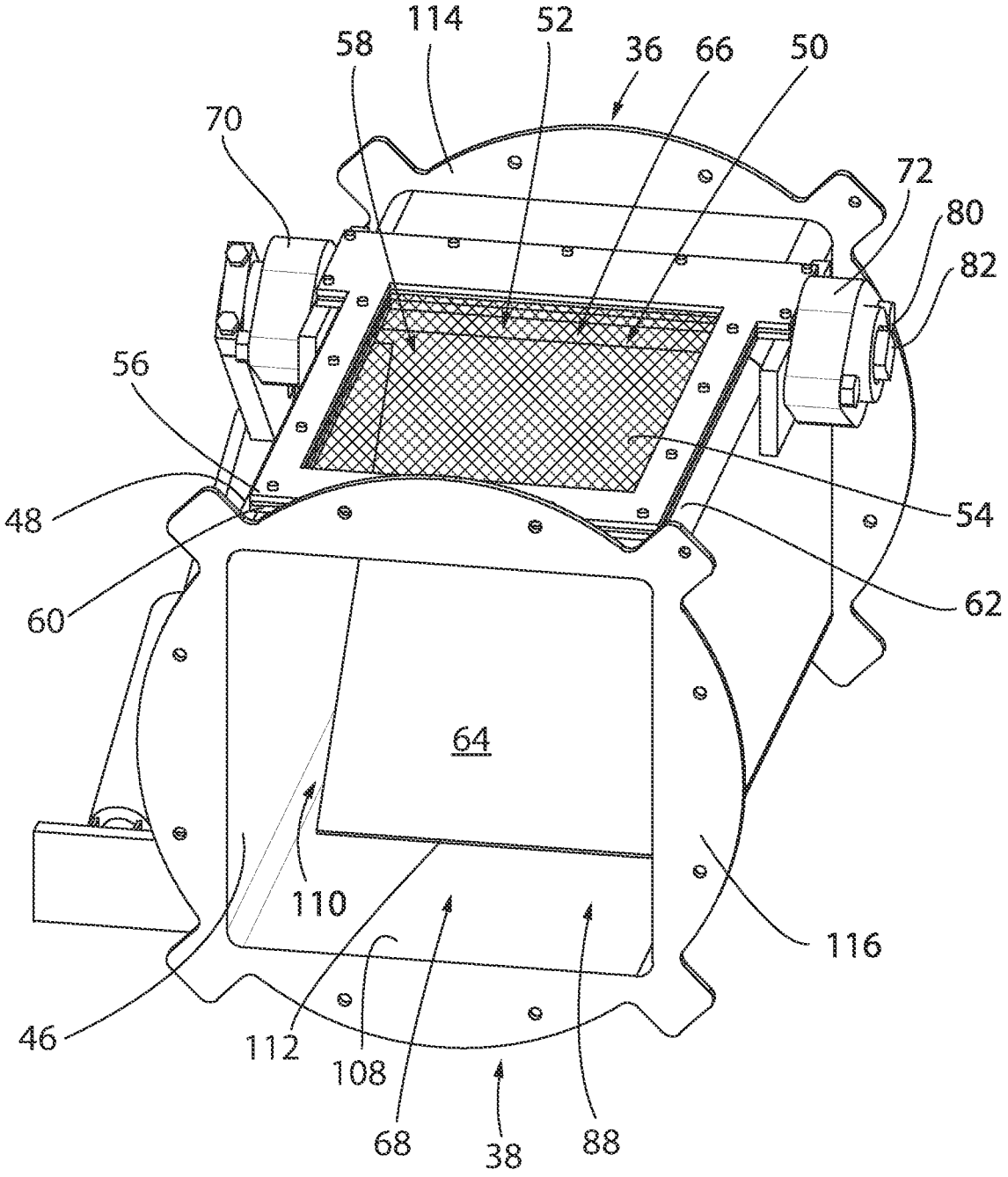
FIG. 3 is a first perspective view of the vacuum diverter shown in FIG. 2.

Referring to FIGS. 1-3, vacuum diverter 18 is preferably disposed adjacent tub 16 within the opening 26 of the frame 12. Vacuum diverter 18 is disposed between and fluidically coupled to the tub 16 and the vacuum source. Vacuum diverter 18 is operative to selectively secure parts or materials being processed relative to the cutting or buck table 14 and allow removal of processed parts therefrom. Said in another way, vacuum diverter 18 selectively introduces the vacuum flow pressure signal or vacuum flow to the cutting table—and any parts associated therewith, and allows bypass of the vacuum flow from the cutting table thereby allowing processed parts to be removed from the vacuum cutting table and subsequent placement of yet to be processed materials relative to the cutting table.

In the representative embodiment of the invention, a first end 36 of the vacuum diverter 18 (FIGS. 2 and 3) is directly coupled to the tub 16. However, in other embodiments of the invention, the first end 36 of the vacuum diverter 18 and the tub 16 may be indirectly fluidly connected to one another. A second end 38 (FIGS. 2 and 3) of the vacuum diverter 18 may be either directly or indirectly coupled to the vacuum source. Regardless of its position relative to the vacuum source and the tub or other structure associated with the vacuum cutting table, vacuum diverter 18 is constructed to selectively fluidly couple the vacuum source and the tub 16 associated with the cutting buck. Preferably, vacuum diverter 18 is disposed proximate tub 16 and the vacuum source to effectuate the selectively communication of the vacuum flow pressure signal therebetween and such that vacuum diverter 18 is conveniently accessible relative to the other structures of the waterjet vacuum table cutting system.

While FIG. 2 illustrates a connection tube 32 disposed between the second end 38 of the vacuum diverter 18 and the vacuum source, it is contemplated that the second end 38 (FIGS. 2 and 3) of the vacuum diverter 18 may be directly coupled to the vacuum generation source in other embodiments of the invention. Additional elements of vacuum diverter 18 and the configuration thereof are described in further detail below with respect to FIGS. 2-4.

Still referring to FIG. 1, guard cover 20 is disposed adjacent buck plate 14 and extends from the front wall 22 to the rear wall 24. It is further contemplated that the guard cover 20 is disposed generally above and in spaced relation to vacuum diverter 18 and mitigates the collection of cutting material debris proximate vacuum diverter 18. In the illustrated embodiment of the invention, guard cover 20 is a transparent material, such as, but not limited to, a LEXAN™ polycarbonate or glass sheet. In alternative embodiments of the invention, the guard cover 20 may be transparent, opaque, or any variant thereof. The guard cover 20 may also be transitionable or moveable between an open position 40 (FIG. 2) wherein diverter 18 is accessible or serviceable and a closed position 42 (FIG. 1) associated with preventing access by personnel and/or debris to areas proximate diverter 18. In the embodiments of the invention using a transparent or semi-transparent guard cover 20, the components under the guard cover 20, such as the vacuum diverter 18, can be visually inspected when the guard cover 20 is in the closed orientation or position 42.

In the closed position 42, the guard cover 20 is preferably oriented horizontally, or substantially horizontally and positioned such that a lower surface 44 of the guard cover 20 is supported by the upper surface 28 of the frame 12. In the open position 40, the guard cover 20 is oriented at an angle such that service personnel or the like can access those components, such as the vacuum diverter 18, disposed generally underneath the guard cover 20 when guard cover 20 is oriented in the closed position 42. It is contemplated that the guard cover 20 may be rotated or raised from the closed position 42 to the open position 40 and rotated or lowered from the open position 40 to the closed position 42.

FIG. 2 is a partial detail perspective view of a portion of frame 12 and vacuum diverter 18 of the water jet device 10 and shows guard cover 20 oriented in an open position 40 relative to frame 12 thereby exposing vacuum diverter 18. The vacuum diverter 18 includes a housing or hollow body 46 that is defined by a first end 36 that is adjacent tub 16 and buck plate 14, a second end 38 that is opposite the first end 36 and directed toward a vacuum source, and a plurality of sidewalls 48 that extend between respective ends 36, 38.

Figure 7:
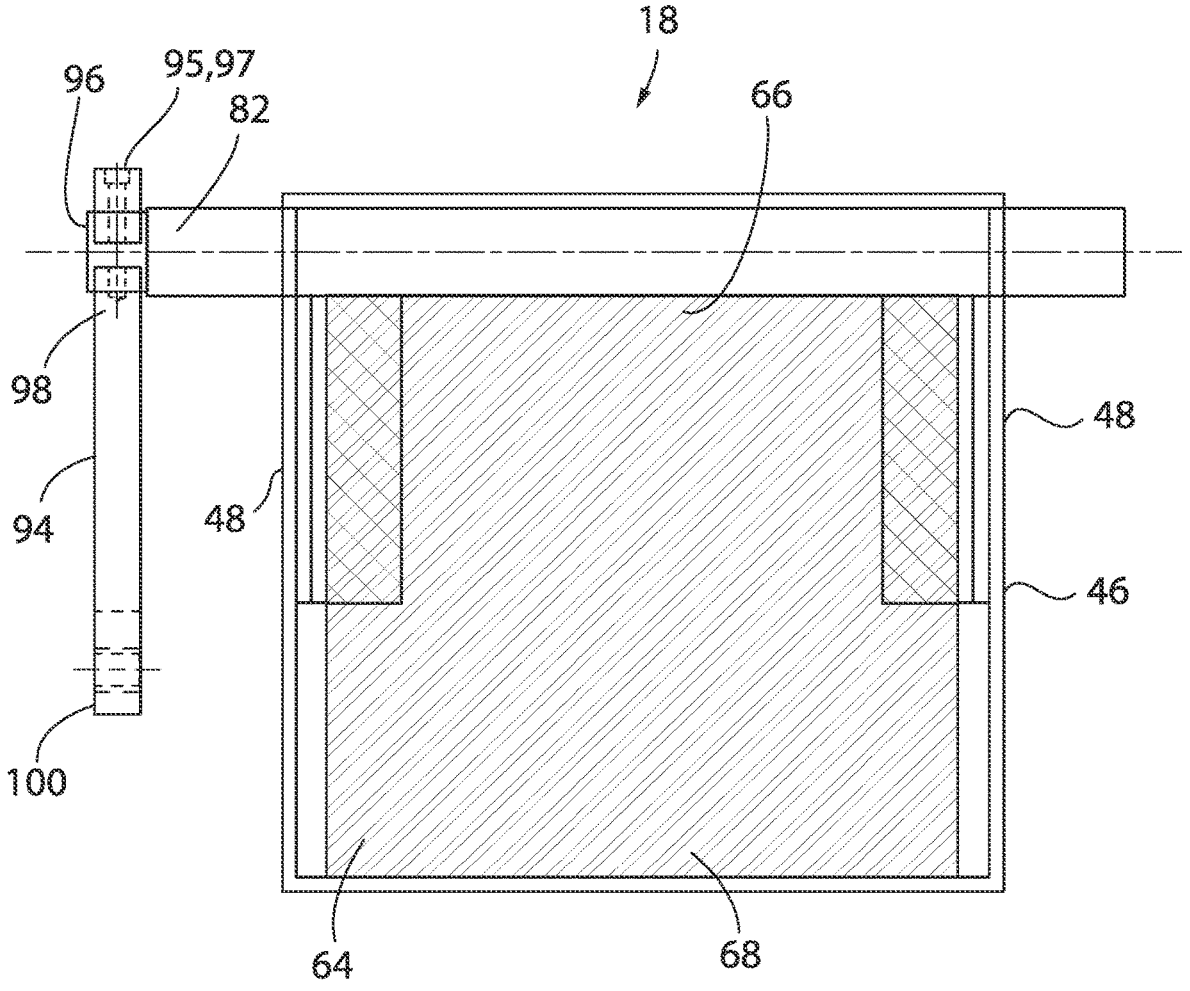
FIG. 7 is a graphical end elevation view of the simplified vacuum diverter shown in FIG. 5.
Figure 8:
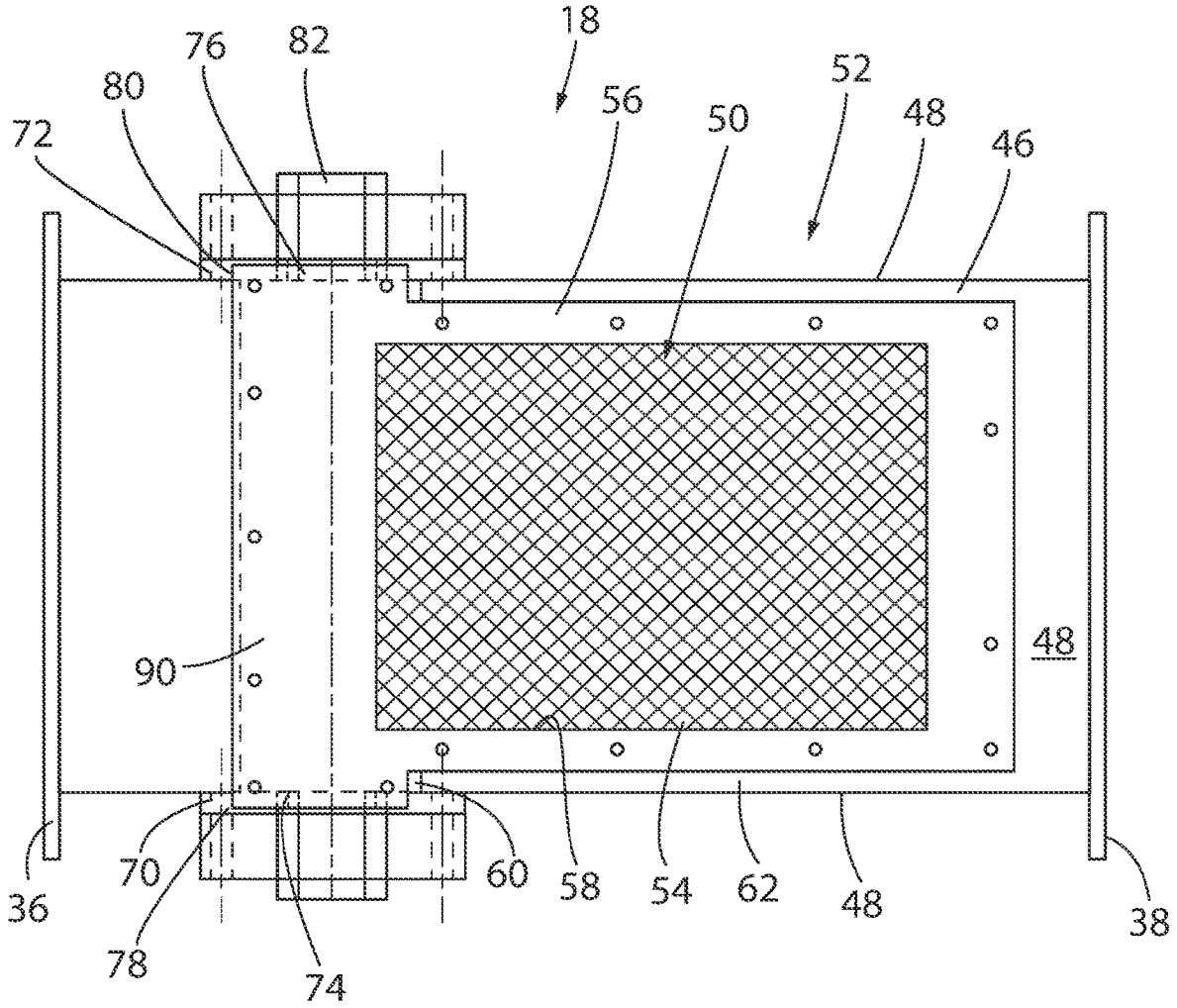
FIG. 8 is a graphical top plan view of the simplified vacuum diverter shown in FIG. 5.

Referring to FIGS. 2, 3, and 8, at least one side wall 48 of the hollow body 46 preferably includes a window or opening 50 that is formed therethrough. Opening 50 provides an inspection/safety window 52 through which a user may visually inspect a portion of the interior passage defined by vacuum diverter 18 and which is described further below with respect to FIGS. 3-4 and 7. In order to mitigate the passage of debris or other unintended materials into the interior spaces defined by vacuum diverter 18, an expanded metal panel or mesh grill is preferably disposed across opening 50 associated with inspection window 52. Inspection window 52 allows users or service personnel to remotely visually inspect the status and condition associated with the internal portions associated with operation of vacuum diverter 18. As disclosed further below, such a consideration allows ready and remote visual inspection as to the operating condition of internal workings of vacuum diverter 18 so as to maintain the desired condition thereof and/or provide access upon the need to service the same.

Figure 4:
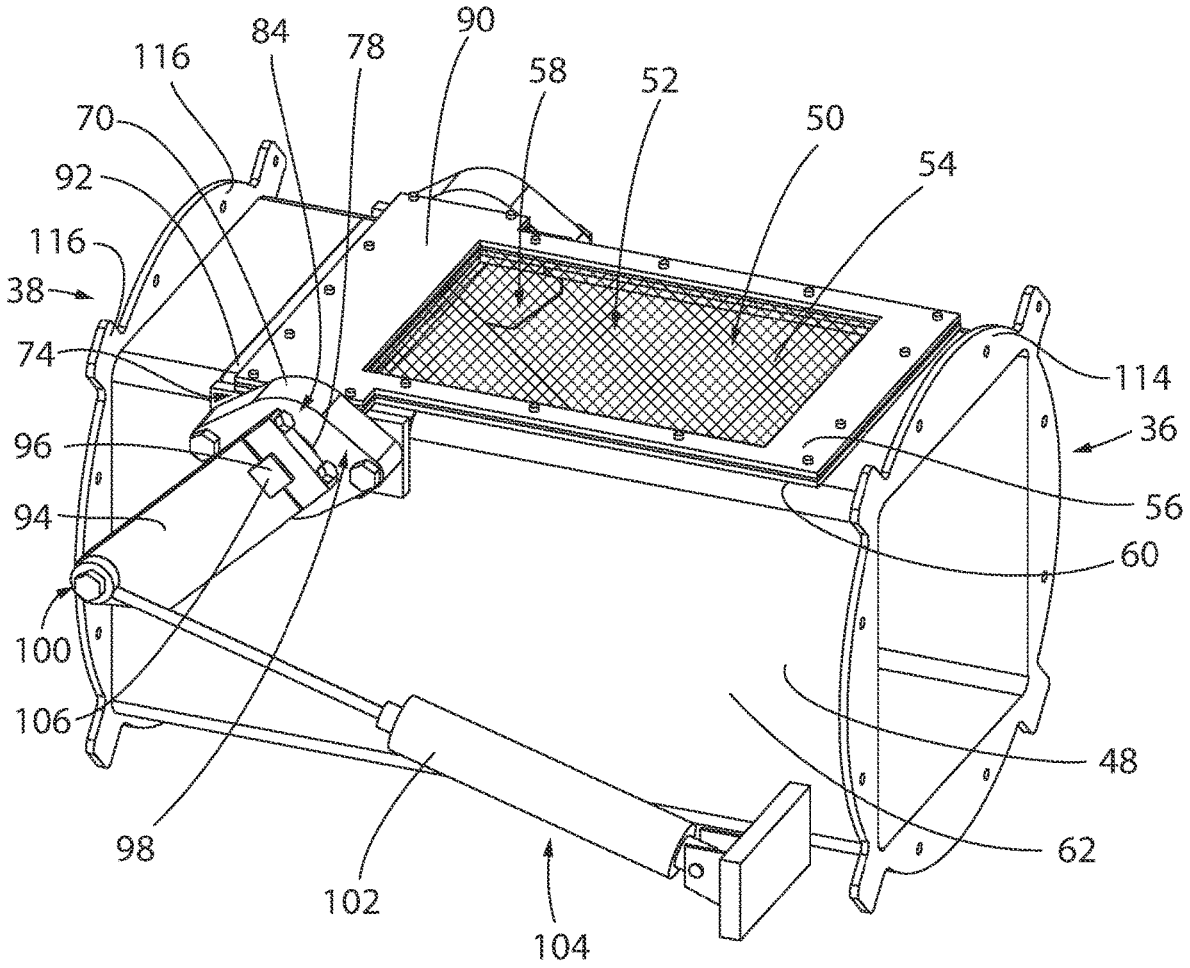
FIG. 4 is a second perspective view of the vacuum diverter shown in FIG. 2.

FIGS. 3 and 4 depict an end perspective view and a lateral side perspective view of vacuum diverter 18, respectively. While the representative embodiment of the housing or hollow body 46 of vacuum diverter 18 is shown as having a generally rectangular shape and cross-section, it is appreciated that hollow body 46 could be provided in any number of cross-sectional shapes which are considered within the scope of the present application.

Referring to FIGS. 3, 4, and 8, inspection window 52 may be provided with a frame or window frame 56 configured to removably cooperate with a respective sidewall 48 of the hollow body 46 between ends 36, 38. When provided in such a methodology, the mesh grill 54 is preferably disposed within an opening 58 defined by window frame 56. In addition, a gasket 60 may be disposed between the frame 56 and an outer surface 62 of the sidewall 48 to establish a seal and maintain a vacuum pressure condition within the hollow body 46. As previously stated, the frame 56 may be removably coupled to the sidewall 48 to allow a user to remove the frame 56 to easily access the interior of the hollow body 46 for maintenance and/or service associated with maintaining the desired operability of vacuum diverter 18 as disclosed further below.

FIG. 3 is a perspective view and FIG. 7 is a graphical elevation cross-section view of vacuum diverter 18 from a direction associated with second end 38 of the vacuum diverter 18 and provides a view of an interior or interior passage of hollow body 46. A valve, valve plate, or valve flap 64 is disposed within the hollow body 46 and moveable relative thereto. The valve flap 64 extends from a first end 66 that is located nearer the first end 36 of vacuum diverter 18 to a second end 68 that is spaced apart from the second end 38 of the vacuum diverter 18. As disclosed further below, first end 66 of valve flap 64 is secured to a shaft that extends through hollow body 46 such that second end 68 of valve flap 64 is oriented in a cantilevered fashion relative to the association of first end 66 of valve flap 64 with the shaft. Valve flap 64 is configured to extend laterally between opposing sidewalls 48 of the hollow body 46 and such that second end 68 of valve flap 64 can be selectively associated with the opposing laterally extending sidewalls to determine a discrete desired flow path associated with the vacuum pressure fluid flow during operation of diverter 18.

First and second bearing mounts 70, 72 (FIGS. 5, 6, 8) are removably coupled to an outer surface 62 of opposing sidewalls 48 of the hollow body 46. Each bearing mount 70, 72 defines a respective orifice 74, 76 that is shaped and constructed to receive a respective bearing 78, 80. A shaft 82 extends across the cavity defined by hollow body 46 such that opposing end portions of shaft 82 are rotationally supported by cooperation with a respective bearing 78, 80. Shaft 82 is received in a respective orifice 84, 86 of each respective bearing 78, 80.

As mentioned above, the first end 66 of valve flap 64 is coupled, attached, permanently affixed, welded, or otherwise secured to shaft 82 such that rotation of shaft 82 causes the valve flap 64 to pivot or rotate between a first position 88 (FIGS. 3, 7) and a second position (not shown) wherein valve flap 64 generally overlies or otherwise obstructs the fluid flow passage associated with window 52 as disclosed further below. As should be appreciated from FIG. 1, when valve flap 64 is oriented in first position 88 shown in FIG. 3, vacuum flow originating from the direction associated with second end 38 of vacuum diverter 18 is accommodated by a suitable flow through window 52 such that parts may be removed and/or otherwise freely associated with the cutting or buck table 14. Rotation of valve flap 64 relative to housing or hollow body 46 from the first position 88 toward the second position allows the vacuum flow associated with source and second end 38 to be directed toward first end 36 and diverter 18 and therefrom to the cutting table and tub environment. As disclosed further below, motion of the valve flap 64 between the first and second respective positions relative to the vacuum flow paths defined by hollow body 46 allow the selective vacuum securing and releasing of parts relative to the vacuum cutting support assembly.

Referring to FIGS. 3, 4, 7, and 8, a service plate 90 preferably extends along a sidewall 48 of the hollow body 46 proximate the first bearing mount 70 to the second bearing mount 72. Service plate 90 is removably coupled to the sidewall 48 of hollow body 46 and, when removed therefrom, allows access to the shaft 82, and valve flap or valve plate 64 associated therewith. Alternatively, it is further appreciated that service plate 90 can be constructed to support bearing mounts 70, 72 and removeably cooperate with hollow body 46 such that removal of service plate 90 facilitates removal of shaft 82 and valve plate 64 from housing or hollow body 46 when service is required. It should be appreciated that each connection methodology allows both shaft 82 and the valve plate 64 associated therewith, to be removed from hollow body 46 via translation of the shaft and plate assembly in a crossing direction relative to the axis of rotation associated with shaft 82. Such considerations substantially improve the ability to expeditiously and efficiently service diverter 18 due to degradation of the components thereof.

It is also appreciated that the functionality associated with service plate 90 may be formed as a separate structure as described above, or, as shown in FIG. 8, be provided as a portion of frame 56 associated with inspection window 50. That is, it is envisioned that service plate 90 may be separate from or integrated with the window frame 56 as described above. Similar to the window frame 56, a gasket 92 is disposed between the service plate 90 and the outer surface 62 of the sidewall 48 to establish a seal and maintain passage of a desired vacuum flow signal through hollow body 46. In the representative embodiments of the invention, gaskets 60, 92 are urethane gaskets, but may individually comprise other materials in varying embodiments of the invention.

Figure 5:
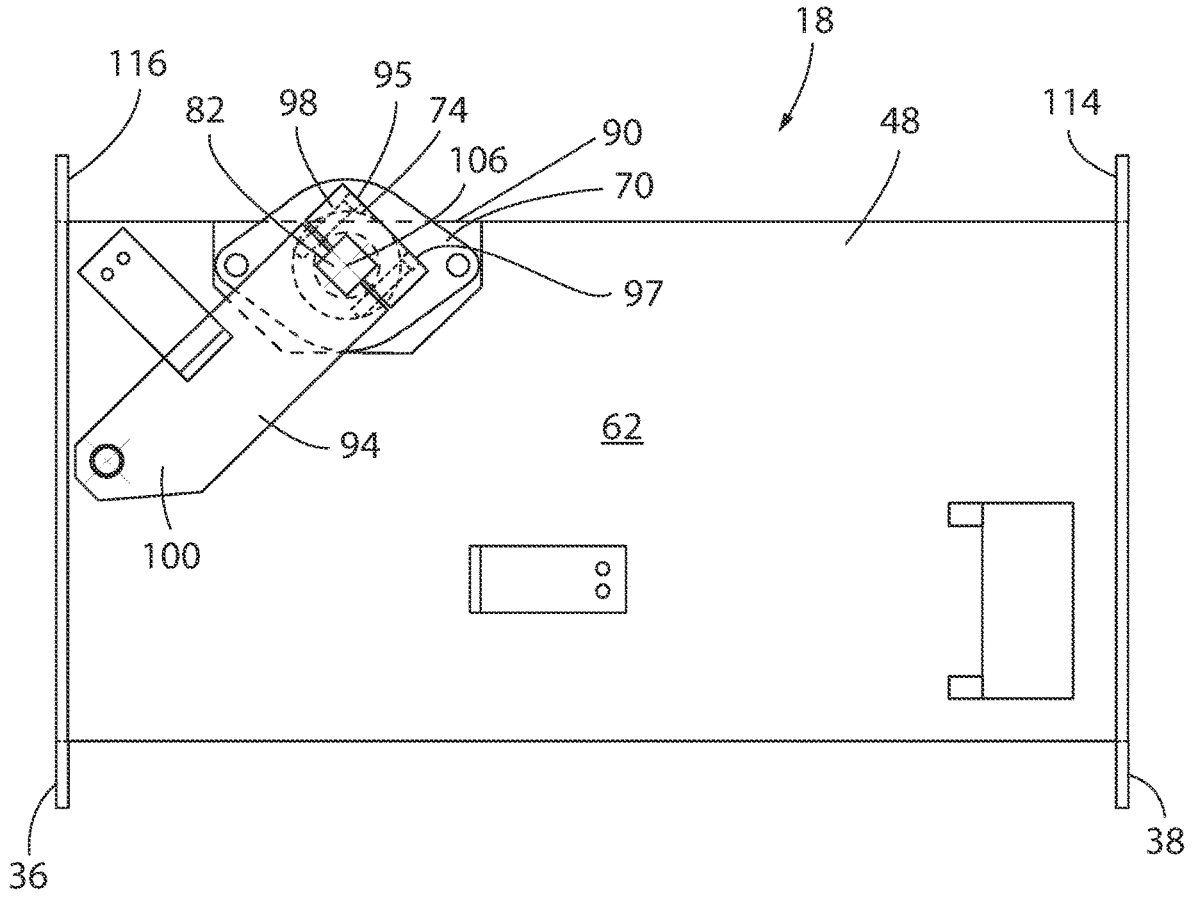
FIG. 5 is a graphical side elevation view of a simplified vacuum diverter constructed in accordance with the vacuum diverter illustrated in FIGS. 3 & 4.
Figure 6:
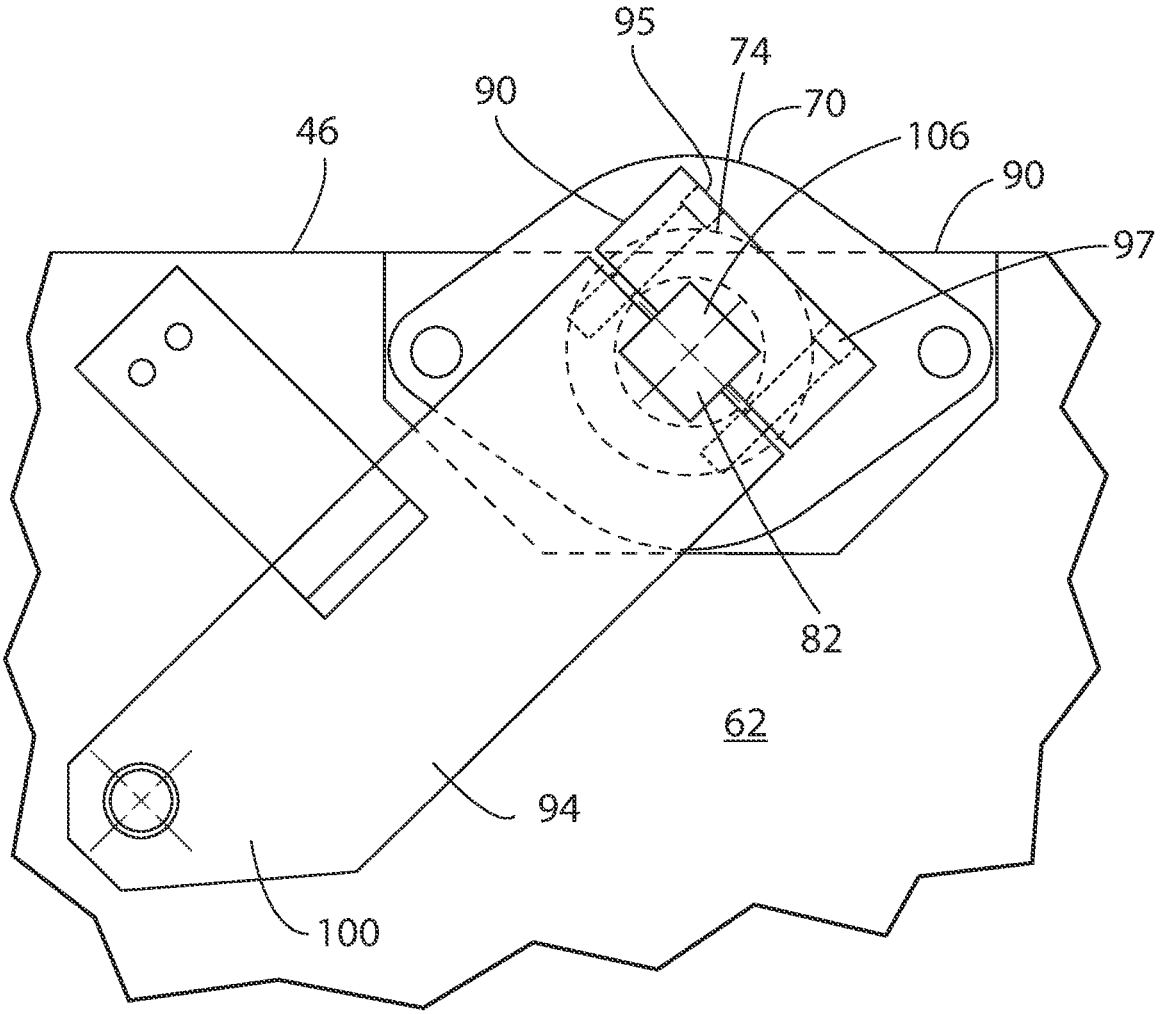
FIG. 6 is an enlarged side elevation detail view of a diverter valve flap or valve plate drive arm arrangement of the vacuum diverter shown in FIG. 5 and that preferably is driven by a prime mover, such as a fluid powered prime mover, e.g., a pneumatic or hydraulic cylinder (not shown in FIG. 6) to displace the valve flap or valve plate between at least a plurality of, preferably at least a plurality of pairs, i.e., at least three, vacuum diverter operating positions.

FIGS. 3-7 further illustrate a crank or pivot arm 94 that is disposed along a sidewall 48 of the hollow body 46 and oriented perpendicular to the shaft 82. Said in another way, pivot arm 94 is secured to shaft 82 and extends in an outward radial direction relative thereto. Preferably, pivot arm 94 is secured to a distal end of shaft 82 with a secure and robust mechanical interaction therebetween. As shown in FIGS. 4-6, a square shaped interface is provided between pivot arm 94 and shaft 82 although other geometric lobed or keyed interactions could be provided between pivot arm 94 and shaft 82 to achieve the desired robust engagement therebetween such that rotation of pivot arm 94 is translated to shaft 82 to effectuate rotation of valve plate 64 relative to the passage defined by hollow body 46 so as to effectuate the desired passage of the vacuum pressure flow to either of buck plate 14 or to atmosphere to achieve the desired material securing or releasing operation. It is further appreciated that pivot arm 94 can be constructed to cooperate in a slideable manner generally aligned with the axis of rotation of shaft 82, or as shown in FIGS. 6 and 7, be constructed to include a split joint connection methodology wherein a portion of shaft 82 is selectively captured between respective separable portions of arm 94. As should be appreciated from FIGS. 6 and 7, a plurality of fastener passages 95, 97 effectuate securing of the respective portions of arm 94 to each other with the lobed driving arrangement defined by shaft 82 captured therebetween.

Regardless of the specific construction, pivot arm 94 is coupled to a first end 96 of the shaft 82 that extends beyond the first bearing mount 70. In the representative embodiment of the invention, the shaft 82 is coupled to the pivot arm 94 adjacent a first end 98 of the pivot arm 94. However, in other embodiments of the invention, the shaft 82 may be coupled to the pivot arm 94 at any location along a length of the pivot arm 94. It should be further appreciated that the respective bearing mounts 70, 72 are not shown in the graphic representation of diverter assembly 18 shown in FIG. 7.

As shown in FIG. 4, a second end 100 of the pivot arm 94 is coupled to a linear actuator such as a pneumatic cylinder 102. It is appreciated that the functionality of the linear actuator could be provided in various methodologies such as hydraulic, electric, or electromechanical actuators or other actuator methodologies such as rotational actuators such as electric, hydraulic, or pneumatic motors, worm, cam or linear drives, transmissions, or the like. When provided as a linear actuator, such as pneumatic cylinder 102 as shown in FIG. 4, operation of the actuator transitions between an extended position 104 (FIG. 4) and a retracted position (not shown) to manipulate a radial orientation of valve flap 64 relative to the interior passage of hollow body 46 as disclosed further below.

As the pneumatic cylinder 102 transitions between the extended and retracted positions, pivot arm 94 rotates about the location or axis 106 associated with the coupling of pivot arm to shaft 82. Actuation of cylinder 102 effectuates rotation of shaft 82 relative to hollow body 46 and thereby translation of valve flap 64 relative to the fluid flow passage internal to hollow body 46. When pneumatic cylinder 102 is in the extended position 104, valve flap 64 is oriented in the first position 88 (FIGS. 3, 7) such that the vacuum flow communicated to hollow body 46 from the vacuum source is satisfied from a flow of ambient environment air communicated into hollow body 46 via opening 50. Alternatively, when pneumatic cylinder 102 is in the retracted position, valve flap 64 achieves a second position relative to the cavity defined by hollow body 46 such that the flow associated with the vacuum source is communicated through the respective first and second ends 36, 38 of hollow body 46 and thereby to the cutting table or buck plate 14. Actuation of the linear actuator or pneumatic cylinder 102 between the extended and retracted positions transitions valve flap 64 between the first and second positions relative to hollow body 46 so as to selectively effectuate a vacuum hold pressure associated with cutting operations relative to materials associated with buck plate 14.

In the first position 88, the valve flap 64 is oriented at an angle relative to the passage defined by hollow body 46 such that the valve flap 64 engages an interior surface 108 of each sidewall 48 of the hollow body 46 to form a vacuum seal within the hollow body 46 as a function of the desired vacuum pressure flow path. In a preferred embodiment, the first end 66 of the valve flap 64 engages gasket 92 below the service plate 90 thereby forming a seal therewith. When the valve flap 64 is in the first position 88, the valve flap 64 fluidically connects the second end 38 of the vacuum diverter 18 to the opening 50 in the sidewall 48. That is, the vacuum associated with the second end 38 of the vacuum diverter 18 pulls air from the opening 50 through sidewall 48. As such, the pull of air or vacuum flow pressure is disassociated with the buck plate 14 such that working materials can be translated relative thereto.

When oriented in the second position relative to the cavity defined by hollow body 46, the valve flap 64 is oriented horizontally or substantially horizontally against the opening 50 in the sidewall 48 in order to form a vacuum seal against the sidewall 48 and insulate the interior of the hollow body 46 from the opening 50. When the valve flap 64 is in the second position, the valve flap 64 fluidically connects the second end 38 of the vacuum diverter 18 to the first end 36 of the vacuum diverter 18. In turn, the vacuum associated with the second end 38 of the vacuum diverter 18 pulls air from the tub 16 and buck plate 14 associate with the first end 36 of the vacuum diverter 18. As such, when valve flap 64 is oriented in the second position, working materials are secured to the upper surface 34 of the buck plate 14 by the vacuum flow. The vacuum flow also drawings a portion of the cutting fluid flow and particulate debris associated with the cutting operation toward the vacuum flow source.

As shown in FIG. 3, the valve flap 64 may include a gasket 110 along its perimeter 112 to assist with sealing the valve flap 64 against the interior walls of hollow body 46. FIGS. 3 and 4 also illustrate that the first and second ends 36, 38 of the vacuum diverter 18 may include flange elements 114, 116, respectively, to assist with securing the vacuum diverter 18 between the vacuum source and tub 16 and providing a fluidly sealed connection therebetween.

Referring briefly back to FIG. 1, water jet device 10 is shown as preferably including one or more light curtains 118. The light curtains 118 are preferably located adjacent the frame 12. As shown in FIG. 1, the light curtains 118 may be oriented both horizontally and vertically. In other embodiments of the invention, the light curtains 118 may be oriented at any angle. The light curtains 118 create a perimeter around the frame 12 of the water jet device 10 and are constructed to prevent operation of cutting devices and/or translation of automated systems, such as robots or the like, if any of the respective light curtains indicate the presence of obstructions, operators, or service personnel within the perimeter bounded by the light curtains.

Preferably, the rigid structures of each of the hollow body 46, valve flap 64, and shaft 82 are constructed of stainless steel metal materials. Since valve flap 64 and shaft 82 can be removed from hollow body 46 in a crossing direction relative to the axis of rotation of shaft 82, valve flap 64 can be permanently affixed to shaft 82 with or without the use of extraneous fasteners. In a preferred embodiment, valve flap 64 is welded to shaft 82 such that shaft and valve flap can be replaced as a unit or serviced by suitable metal working methodologies. Constructing hollow body 46, valve flap 64, and shaft 82 from stainless steel materials allows vacuum diverter 18 to better withstand the harsh environment associated with the fluid and particulate debris flow through the diverter and the surrounding atmosphere associated with the water table cutting environment. Additionally, the ability to remove the shaft and valve flap in a lateral direction relative to the axis of rotation of the shaft allows expedient removal and replacement of the shaft and valve flap during servicing to mitigate downtime events associated with degradation of the ability of the diverter assembly to provide the desired vacuum pressure flow directions.

Although the best mode contemplated by the inventor for carrying out the present invention is disclosed above, practice of the above invention is not limited thereto. It will be evident that various additions, modifications and rearrangements of the features of the present invention may be made without deviating from the spirit and the scope of the underlying inventive concept as defined by the appending claims.

I claim:

1. A vacuum diverter assembly comprising:

a hollow body having a first end, a second end, a plurality of sides, and a window formed in one of the plurality of sides;

a valve flap disposed within the hollow body and moveable between a first position and a second position relative to the hollow body;

a bearing associated with each of two opposite sides of the hollow body;

a shaft that extends between the bearings and is rotatable relative to the hollow body; and wherein the valve flap is coupled to the shaft, wherein the second end and the window are fluidly connected to each other via the hollow body, wherein the first end and second end are fluidly connected to one another, and wherein the window is oriented to allow visual inspection of the position of the valve flap relative to the hollow body, wherein the window is further defined by a window frame that is removably coupled to one of the plurality of sides of the hollow body, wherein a gasket is disposed between the hollow body and the window frame.

2. The vacuum diverter assembly of claim 1 wherein the valve flap extends from a location adjacent the first end of the hollow body to a location spaced apart from the second end of the hollow body.

3. The vacuum diverter assembly of claim 1 further comprising a linear actuator that is coupled to the shaft and is operable between an extended position and a retracted position to transition the valve flap from the first position to the second position.

4. The vacuum diverter assembly of claim 1 further comprising a mesh grill disposed within an opening of the window.

5. The vacuum diverter assembly of claim 1 further comprising a service plate that removably cooperates with a sidewall of the hollow body along a portion of the sidewall associated with the shaft and a gasket that is disposed between the hollow body and the service plate.

6. The vacuum diverter assembly of claim 5 wherein a top end of the valve flap engages the gasket underneath the service plate when the valve flap is in the first position.

7. The vacuum diverter of claim 6 wherein the valve flap includes a gasket that sealingly cooperates with an inner surface of the hollow body.

8. A water jet system comprising:

a frame;

a buck plate disposed atop the frame;

a tub disposed underneath the buck plate; and a vacuum diverter disposed adjacent the tub, the vacuum diverter comprising:

a housing having a first end, a second end, a plurality of sides, and an opening formed in one of the plurality of sides;

a first bearing and a second bearing associated with opposite lateral sides of the housing;

a shaft supported by the first bearing and the second bearing and extending across a cavity defined by the housing and supported by the housing such that the shaft can be removed from the housing in a direction transverse to an axis of rotation of the shaft; and a valve flap disposed within the housing and coupled to the shaft, the valve flap being moveable relative to the housing between a first position and a second position, wherein the opening and the second end defined by the housing are fluidly connected to one another and to the second position via the cavity, and wherein the first end and the second end of the housing are fluidly connected to one another via the cavity, and a linear actuator coupled to a first end of the shaft and operable between a retracted position and an extended position; and wherein operation of the linear actuator between the extended position and the retracted position causes the shaft to rotate and the valve flap to transition between the first position to the second position.

9. The water jet system of claim 8 further comprising a window frame removably coupled to one of the plurality of sidewalls of the housing and extending about the opening and a gasket disposed between the housing and the window frame.

10. The water jet system of claim 9 further comprising an expanded metal grill supported by the window frame and traversing the opening.

11. The water jet system of claim 8 further comprising a service plate removeably coupled to a sidewall of the housing along a portion of the sidewall associated with the shaft and a gasket disposed between the housing and the service plate.

12. The water jet system of claim 11 wherein a free end of the valve flap engages the gasket disposed between the housing and the service plate when the valve flap is oriented in the first position.

* * * * *